US006004185A

United States Patent [19]

Rehkemper et al.

[11] Patent Number: 6,004,185

[45] Date of Patent: Dec. 21, 1999

[54] WALKING TOY ANIMAL

[76] Inventors: Steven Rehkemper, 1030 N. State St., Chicago, Ill. 60610; Jeffrey G. Rehkemper, 1636 N. Wells; Todd J. Hannon, 2022 N. Bissell, both of Chicago, Ill. 60614; Laurie Gallagher, 2338 W. Argyle, Chicago, Ill. 60625

[21] Appl. No.: 09/144,185

[22] Filed: Aug. 31, 1998

[51] Int. Cl.[6] ..... A63H 7/00; A63J 19/00

[52] U.S. Cl. ..... 446/317; 446/364

[58] Field of Search ..... 446/314, 315, 446/316, 317, 320, 321, 355, 364, 365

[56] References Cited

U.S. PATENT DOCUMENTS

| | | | |
|---|---|---|---|
| 2,001,013 | 5/1935 | Davis et al. | 446/316 |
| 2,071,225 | 2/1937 | Buttigieg | 446/320 X |
| 2,593,187 | 4/1952 | Riechelson | 446/317 X |
| 4,816,002 | 3/1989 | Bodrib | 446/317 X |
| 4,964,836 | 10/1990 | Kamei | 446/370 X |

*Primary Examiner*—D Neal Muir

*Attorney, Agent, or Firm*—Jack Shore, Hamman & Benn

[57] ABSTRACT

A walking toy animal which is pulled by a leash. The animal includes a retracting mechanism within the animal housing and secured to the leash to retract the leash essentially within the animal housing when the leash is released. The animal includes resilient leg assemblies whereby when it is pulled it will simulate a walking action.

7 Claims, 1 Drawing Sheet

WALKING TOY ANIMAL

FIELD OF THE INVENTION

This invention relates to a toy animal and more particularly a toy simulation of a standing four legged animal such as a horse which when pulled along a floor or other horizontal surface has a leg movement that is similar to a live walking horse or other four legged animal.

BACKGROUND OF THE INVENTION

There have been a number of toy animals such as dogs, horses, cats etc. that are in the form of pull toys for small children to play with. These animals are constructed so that they can be pulled along the floor by a leash or harness etc. and are designed to include leg portions that permit such animals to simulate the walking movement of a four legged animal. While there have been a number of these animals such as described in Candee patent U.S. Pat. No. 2,636,317, Brodrib U.S. Pat. No. 2,663,970 and Armstrong U.S. Pat. No. 3,190,035 there has not been available a simple toy which can be pulled by a leash, which leash is retractable so that if the leash is not being used it will be out of the way adjacent the head of the animal and in addition to have such an animal that will simulate the walking movement of a live animal yet be very simple in construction, light in weight and capable of being roughly handled.

SUMMARY OF THE INVENTION

In accordance with the present invention there is provided a four legged animal which in the instant application is a horse but obviously it can take other forms such as a dog or cat etc. wherein the horse is made of a two part body construction that is connected together and within which there is a provided a weighted portion to provide proper balance for the animal. The animal is hollowed out and contains therein a novel spring mechanism connected at one end to the body portion and the other end to a spool assembly to which is secured a leash. The spring mechanism is designed so that the leash will normally be retained in a retracted position adjacent the front of the horse when it is not being used. When the leash is being pulled on the leash is extended and the horse will follow there behind. The design of the spring can be calibrated to merely function to return the leash to its retracted position or can be constructed to walk the horse toward the person holding the end of the leash.

The novel toy animal construction also includes incorporated head and tail members as well as front and rear leg portions that are secured in recesses defined by the multipart animal body construction. The feet sections are made of a soft material such as soft polyvinyl chloride. The feet also include paws that will tend to frictionally engage the surface and withstand movement for a short time while the horse is initially pulled forward and thereafter will release to permit the horse to simulate a walking action. The front and rear feet sections are each formed in a generally U-shaped configurations with the legs and paws forming the two legs of a U and the base of the U comprising a transverse section that is held in place by being secured in recesses defined by the housing or retained in place between the two halves of the housing prior to assemblage.

The novel spring construction consists of a torsion spring disposed within a rotatable spool assembly, in which one end is connected to the body of the housing and the other end is connected to the spool assembly about which the leash is wrapped around when then the leash is in the retracted position.

Other objects and advantages will be apparent from the flowing description taken in connection with the accompanying drawings wherein:

FIG. 1 is a perspective view showing the leash being pulled to move the horse forward and illustrating the inner portions of the horse in outline form; and FIG. 2 is an exploded perspective view showing the individual features of the novel horse construction.

DESCRIPTION OF THE PREFERRED EMBODIMENT

Figure 1:
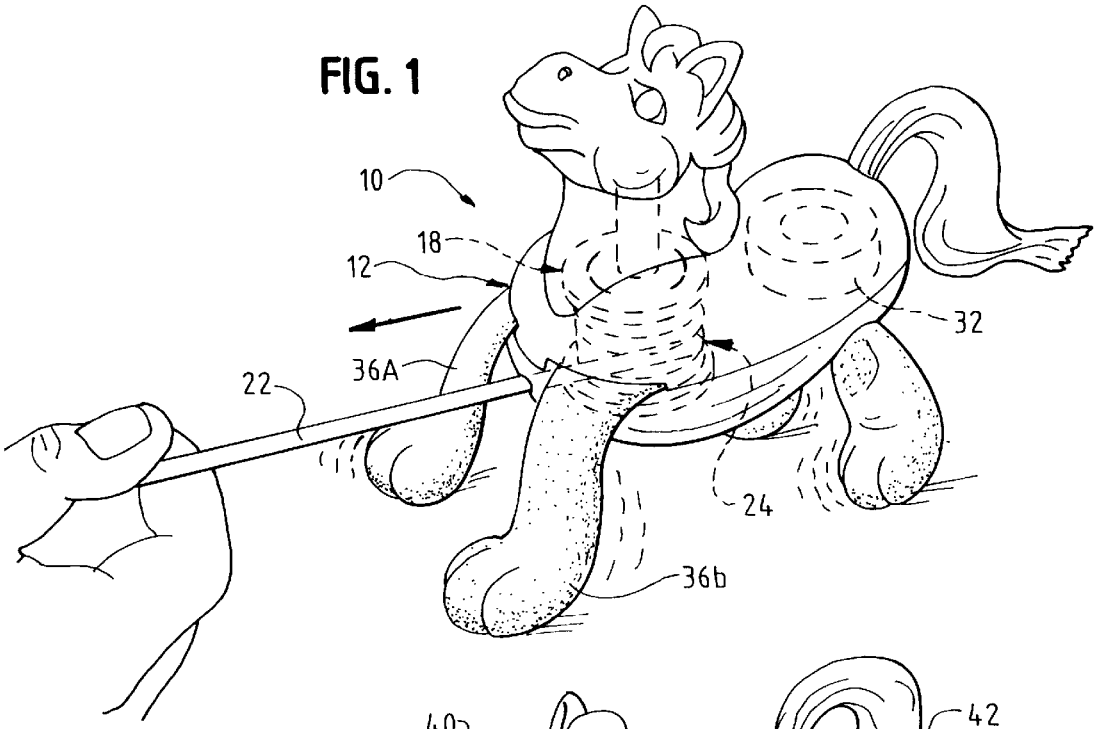
Figure 2:
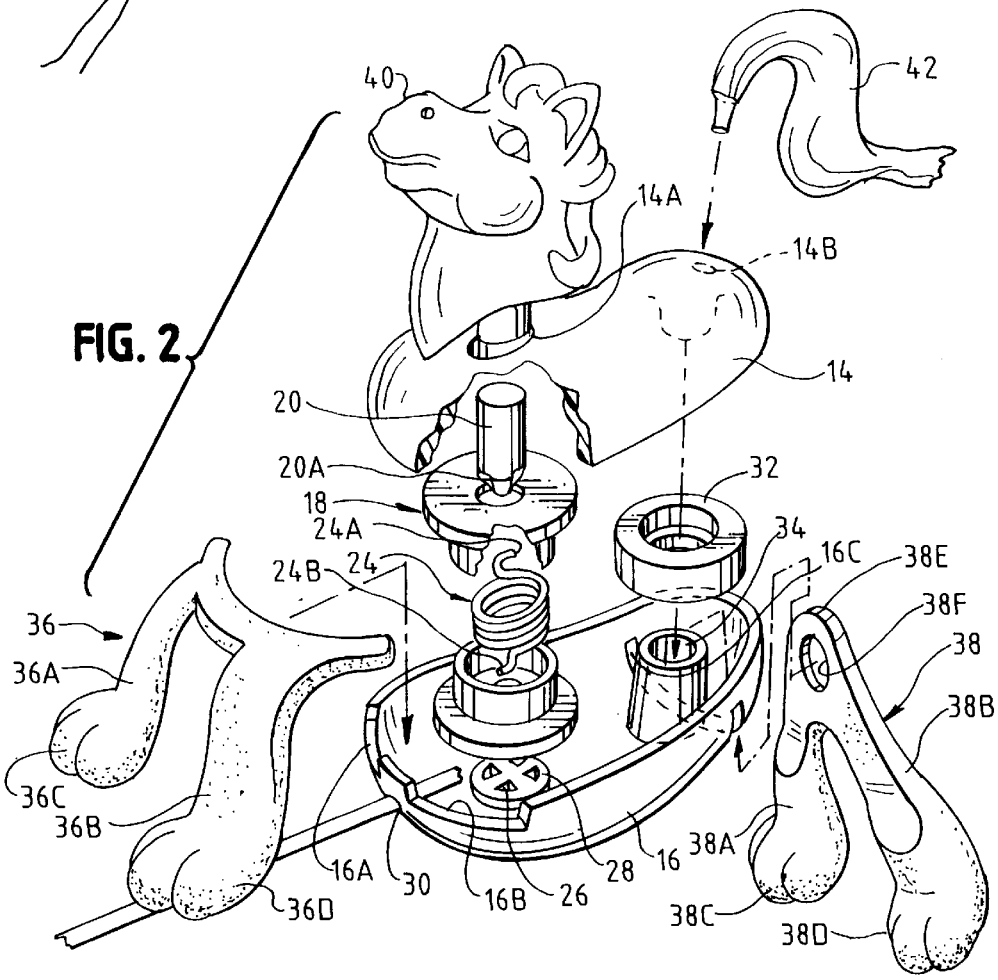

Referring to the figures there is illustrated a horse construction 10 that includes a body assembly 12 consisting of an upper body housing 14 and a lower body housing 16. Located within the housing is a spool assembly 18 that is free to rotate about a spool pin 20 that is fixed in place in the body assembly 12. Wrapped around the spool assembly 18 is the pull member or leash 22 which when in the retracted position is located slightly outwardly of the body assembly 12 so it can gripped and extended to pull the toy horse 10 along the surface on which it is located. The rotation of the spool assembly is controlled by a torsion spring assembly 24 located within the spool assembly 18. The torsion spring 24 is connected at its upper end at 24A to the spool pin 20. The spool pin has projections 20A that extend into openings 26 in plate 28 that is secured to the lower housing 16 to fix the pin 20 in place. The lower portion 24B of the spring 24 is suitably connected to the spool assembly 18. The torsion spring 24 functions to rotate the spool assembly 18 relative to the pin 20 so that in the resting position the leash 22 is wrapped around the spool leaving a small portion extending outwardly of the body assembly 12 so it can be gripped. When the horse is to be played with as a pull toy, the child pulling on the leash 22 will pull it outwardly through the housing opening 30 which will be permitted by the rotation of the spool assembly 18 against the action of the torsion spring 24. The horse will continue to be pulled along the working surface as long as the leash 22 is being held in the extended position. When the child releases the leash it will be retracted around the spool by the action of the torsion spring 24. The spring can be strong enough so that in the event the child stops while holding the leash the spring can, by its residual force move the horse towards the child while wrapping the leash around the spool as it is moving toward the child.

Also located within the housing assembly 12 is a weight 32 that is disposed about a column 34 that functions to suitably balance the horse.

The horse's legs are made of a soft polyvinyl chloride and consists of a front leg assembly 36 and a rear leg assembly 38. The front leg assembly 36 is generally U-shaped and includes two downwardly standing front leg portions 36A, 36B and have paws 36C, 36D located at their outer ends. The transversely extending upper portion 36E interconnects the front leg portions 36A, 36B and fits into recesses 16A, 16B of the lower body portion 16 whereby when the upper and lower body portions 16A, 16B are sonically welded together or otherwise secured the transversely extending portion 36E will be retained in place between the upper and lower body portions 14, 16.

The rear leg assembly 38 is generally U-shaped and also includes downwardly depending legs 38A, 38B each having a paw 38C, 38D at its lower end and a transversely extending portion 38E that fits into a recess 16C formed in the bottom of the lower housing portion 16. Portion 38E includes an opening 38F that hooks over column 34 to positively retain it in position.

The design and construction of the leg assemblies are such that when the horse is pulled along a surface the paws are frictionally retained by said surface until the pulling force overcomes the frictional restraint which will impart a realistic walking movement to the horse so moved. It remains to note that the upper housing 14 includes an opening 14A at its forward end for receiving a horse head 40 and an opening 14B at its rear end for receiving a tail 42.

Other features and advantages of the novel invention will be apparent from the following claims wherein.

What is claimed:

1. A walking animal including a main body housing assembly, front and rear leg assemblies secured to said body assembly, a spool assembly rotatable within said housing assembly, a flexible elongate member for pulling said animal, a rotatable spring mechanism disposed within said housing assembly consisting of a torsion spring that is connected at one end to a rod member secured in said housing and its other end is connected to and located within the spool assembly whereby the pull member can be pulled outwardly relative to the spool to pull the animal along a surface or will be wrapped around the spool when the spring is permitted to retract the pull member into the body of the animal, and a weight portion located in the rear end of the housing assembly to facilitate proper positioning of the animal during the walking movement.

2. A walking animal as set forth in claim 1 in which the front and rear leg assemblies are flexible each of which consist of leg portions having depending paws that are adapted to frictionally engage a walking surface and which will simulate a walking movement when the animal is pulled by the pull member.

3. A walking animal set forth in claim 2 in which the composition of the leg assemblies consists of polyvinyl chloride to give it the proper resiliency and frictional engagement.

4. A walking animal set forth in claim 3 wherein the housing assembly consists of upper and lower body portions and the front leg assembly is generally U-shaped and includes a transverse portion located between and gripped by said body portions and the rear leg assembly is also generally U-shaped and includes an upper transversely disposed section located in a recess defined by the lower body portion.

5. A toy horse walking assembly having an upper body defining recesses receiving a head and tail and a lower body portions defining recesses receiving front and rear leg assemblies, the front leg assembly having an integral transverse portion clamped between the upper and lower body portions and two depending legs with paws at the lower ends thereof adapted to frictionally engage a supporting surface, the legs and paws are constructed of a flexible resilient material, the rear leg assembly includes an integral transverse portion secured in a recess defined in the lower body portion of the horse and two depending legs having paws at the end thereof adapted to frictionally engage a supporting surface and being constructed of a flexible resilient material, and a leash secured to one of said body portions, and means for securing the body portions together whereby when the horse is pulled by the leash the paws are frictionally retained by said surface until the force overcomes the frictional restraint to impart a realistic walking movement to the toy horse being pulled.

6. A walking horse set forth in claim 5 including a spring mechanism connected to the housing and the leash whereby the leash will be retracted relative to the horse when the leash is released.

7. A walking horse as set forth in claim 6 in which the spring mechanism is disposed with a rotatable spool assembly and one end of the spring is secured to the housing and the other end to the spool assembly and the leash is secured to the spool assembly whereby when the spool is rotated by the spring the leash is retracted and wrapped around the spool.

* * * * *